US006207623B1

(12) United States Patent
Butler et al.

(10) Patent No.: US 6,207,623 B1
(45) Date of Patent: Mar. 27, 2001

(54) INDUSTRIAL OILS OF ENHANCED RESISTANCE TO OXIDATION

(75) Inventors: Kevin David Butler; Alison Fiona Miller; Todd Timothy Nadasdi, all of Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/483,695

(22) Filed: Jan. 14, 2000

(51) Int. Cl.[7] ..... C10M 141/06; C10M 141/108
(52) U.S. Cl. ..... 508/273; 508/279; 508/281
(58) Field of Search ..... 508/273, 279, 508/280, 281

(56) References Cited

U.S. PATENT DOCUMENTS

| | | | |
|---|---|---|---|
| 3,775,321 | 11/1973 | Turnquest et al. | 252/42.7 |
| 3,909,420 | 9/1975 | Turnquest et al. | 252/47 |
| 3,926,823 | 12/1975 | Durr et al. | 252/49.9 |
| 3,931,022 | 1/1976 | Chesluk et al. | 252/47.5 |
| 4,871,465 | 10/1989 | Hutchison | 252/47 |
| 4,948,523 | 8/1990 | Hutchison et al. | 252/47 |
| 5,032,300 | 7/1991 | O'Neil | 252/51.5 R |
| 5,094,763 | 3/1992 | Tochigi et al. | 252/46.6 |
| 5,516,440 | 5/1996 | Dasai et al. | 252/32 |
| 5,750,475 | 5/1998 | Berlowitz | 508/258 |
| 5,773,391 | 6/1998 | Lawate et al. | 508/257 |
| 5,885,942 * | 3/1999 | Zhang et al. | 508/273 |

FOREIGN PATENT DOCUMENTS

| | | | |
|---|---|---|---|
| 0735128 | 10/1996 | (EP) | C10M/41/08 |
| 5-9157188 | 9/1984 | (JP) | C10M/1/38 |
| 5-9170277 | 9/1984 | (JP) | C23F/11/12 |
| 07126680 | 5/1995 | (JP) | C10M/141/10 |
| 07228882 | 8/1995 | (JP) | C10M/169/04 |
| 07258677 | 10/1995 | (JP) | C10M/169/04 |

* cited by examiner

*Primary Examiner*—Jacqueline V. Howard
(74) *Attorney, Agent, or Firm*—Joseph J. Allocca

(57) ABSTRACT

A lubricating oil formulation containing a major amount of a base oil of lubricating viscosity and a minor amount of additives comprising a combination of phenyl naphthyl amine, dimercaptothiadiazole or derivative thereof, and triazole or benzotriazole or derivative thereof, exhibiting enhanced resistance to oxidation.

4 Claims, No Drawings

INDUSTRIAL OILS OF ENHANCED RESISTANCE TO OXIDATION

BACKGROUND OF THE INVENTION

1. Field of the Invention

This invention relates to formulated lubricating oil products exhibiting resistance to oxidation through the use of additives.

2. Description of the Invention

The present invention is a lubricating formulation exhibiting enhanced resistance to oxidation, said formulation comprising a major amount of an oil of lubricating viscosity and a minor amount of additives comprising a combination of phenyl naphthyl amine, one or more dimercaptothiadiazoles or derivative thereof, one or more triazoles or benzotriazoles of derivative thereof, but in the absence of diphenyl amine or diamine antioxidants, and to a method for enhancing the oxidation resistance of formulated oils, which do not contain diphenyl amine or diamine antioxidants, by the addition to such oils of a minor amount of a combination of phenyl naphthyl amine, one or more dimercaptothiadiazoles or derivative thereof, and one or more triazoles or benzotriazoles or derivative thereof.

The base oil of lubricating viscosity can be any natural or synthetic base oil, including those derived from paraffinic or naphthenic crude oils, tar sands, shale oil, coal oil, and processed using standard refinery techniques. These may include fractionated distillation, solvent or catalyst dewaxing of raffinate products, solvent extraction of aromatics, hydrotreating, oils produced by severe hydrotreating or hydroprocessing to reduce aromatic and/or olefinic hydrocarbon content, as well as to reduce sulfur and nitrogen content, isomerization of waxy raffinates, etc.

Synthetic oils include oils of the lubricating oil boiling range derived from a Fischer-Tropsch hydrocarbon synthesis process, or from the isomerization of petroleum wax or Fischer-Tropsch synthetic wax, as well as polyalphaolefins, which are hydrogenated oligomers of $C_2$–$C_{16}$ alpha olefins.

The lubricating oil formulation contains a minor amount of additive materials, comprising a phenyl naphthyl amine per se, one or more triazoles, benzotriazoles or derivatives thereof, and one or more dimercaptothiodiazoles or derivatives thereof.

The phenyl naphthyl amine is unsubstituted by any hydrocarbyl group such as alkyl, aryl, or alkaryl group, being substantially just phenyl naphthyl amine (either phenyl alpha naphthyl amine or phenyl beta naphthyl amine).

The amount of phenyl naphthyl amine used ranges from about 0.05 to 1.0 wt %, preferably about 0.3 to 0.8 wt % (active ingredient).

The dimercaptothiadiazole or derivative thereof is represented by the general formula:

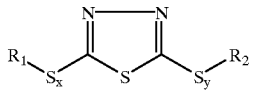

wherein $R_1$ and $R_2$ are the same or different, and are selected from hydrogen, $C_1$–$C_{20}$ hydrocarbyl, or $C_1$–$C_{20}$ alkyl (wherein at least one of $R_1$ or $R_2$ is not hydrogen), and x and y are the same or different integers ranging from 1 to 5, preferably 1 to 2, or mixtures of such materials.

The dimercaptothiadiazole is used in an amount in the range 0.001 to 0.5 wt %, preferably 0.01 to 0.10 wt %.

Benzotriazole or derivative thereof is represented by the general formula:

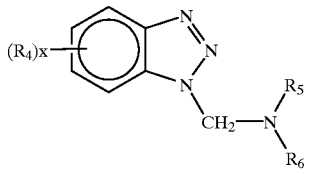

wherein $R_4$ is hydrogen or $C_1$–$C_{10}$ alkyl, preferably hydrogen or $C_1$–$C_2$ alkyl, and x is an integer ranging from 1 to 4, preferably 1; and $R_5$ and $R_6$ are hydrocarbyl, commonly 2-ethylhexyl, or other substantially hydrocarbyl. Closely related triazole derivatives represented by the structures below, are also commonly used as substitutes for benzotriazole derivatives in lubricating oils, where $R_{11}$ and $R_{12}$ are hydrocarbyl, commonly 2-ethylhexyl, or other substantially hydrocarbyl.

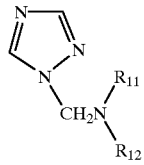

The triazole or benzotriazole and/or derivative thereof is used in an amount in the range 0.005 to 0.5 wt %, preferably 0.01 to 0.20 wt % (active ingredient).

The lubricating oil containing the three above recited additive components in combination may also contain other typical lubricant additives, including other antioxidants of the phenolic and/or aminic type, pour point depressants such as poly(meth)acrylates, ethylene/vinyl acetate copolymers, acetate/fumarate copolymers, etc., antiwear/extreme pressure additives such as hydrocarbyl substituted phosphate esters, sulfur containing compounds such as metal or non-metal hydrocarbyl dithiophosphates, or dithiocarbamates, e.g., ZDDP, or sulphurised olefins or esters, rust inhibitor agents, including alkyl succinimides and derivatives thereof, and/or carboxylic acids or their partially or fully esterified derivatives, and/or sulfonates, and/or partially oxidised hydrocarbons, etc., demulsifiers, antifoamants, dyes, etc. The amounts of such additional additives used, if any, is left to the discretion of the practitioner in response to his own formulation requirements.

EXAMPLES

The following examples demonstrate the practice of specific embodiments of this invention and comparison cases, but should not be interpreted as limiting the scope of the invention.

Example 1

Four formulations were evaluated for resistance to oxidation. Three of the formulations employed the additive combination of non-alkylated phenyl naphthyl amine, benzotriazole derivative and thiadiazole derivative, while the fourth employed a different combination of additives. The formulations and the results from the RBOT (ASTM D2272) and TOST (ASTM D943) oxidation tests are reported in Table 1. Formulations 1, 2 and 3, containing the presently recited additive combination, far exceed Formulation 4, which does not contain the presently recited combination, in terms of oxidation resistance.

TABLE 1

| Components (wt %) Base Stock | Formulation 1 Severely Hydrotreated Base Stock Blend | 2 Severely Hydrotreated Base Stock Blend | 3 Hydro-cracked Base Stock Blend | 4 Solvent Refined Base Stock Blend |
|---|---|---|---|---|
| phenyl naphthyl amine antioxidant (98.5% active) | 0.40 | 0.40 | 0.40 | — |
| dimercapto-thiadiazole (undiluted) | 0.01 | 0.01 | 0.01 | — |
| benzotriazole derivative (undiluted) | 0.08 | 0.08 | 0.08 | — |
| succinimide rust inhibitor (50% active) | 0.1 | 0.1 | 0.1 | — |
| pour depressant (50% active) | 0.05 | 0.05 | 0.05 | 0.10 |
| antifoamant (40% active) | 0.01 | 0.01 | 0.01 | 0.008 |
| demulsifier | 0.004 | 0.004 | 0.004 | 0.004 |
| phenolic antioxidant | — | 0.24 | — | 0.50 |
| diphenylamine antioxidant | — | — | — | 0.03 |
| triazole derivative | — | — | — | 0.08 |
| Test Results | | | | |
| RBOT life (minutes) | 2905 | 2430 | 3120 | 627 |
| TOST life (hours) | >14,000 | >16,000 | 13,660 | 5083 |

Example 2

The antioxidant performance in the RBOT test of four different groups of formulated oils, based on four different base stocks and containing constant amounts of benzotriazole, thiadiazole, and succinimide, but different concentrations of non-alkylated phenyl naphthyl amine, is reported in Table 2.

TABLE 2

| Base Stock | Phenyl naphthyl amine | Thiadiazole | Benzo-triazole | Succini-mide (50% active) | RBOT (minutes) |
|---|---|---|---|---|---|
| severely hydro-treated basestock blend | 0.3 | 0.01 | 0.08 | 0.08 | 1997 |
| | 0.4 | 0.01 | 0.08 | 0.08 | 2449 |
| | 0.6 | 0.01 | 0.08 | 0.08 | 2955 |
| | 0.7 | 0.01 | 0.08 | 0.08 | 3105 |
| | 0.8 | 0.01 | 0.08 | 0.08 | 3165 |
| | 0.9 | 0.01 | 0.08 | 0.08 | 3090 |
| | 1.0 | 0.01 | 0.08 | 0.08 | 2880 |
| hydro-cracked basestock blend | 0.3 | 0.01 | 0.08 | 0.08 | 2877 |
| | 0.4 | 0.01 | 0.08 | 0.08 | 3327 |
| | 0.6 | 0.01 | 0.08 | 0.08 | 3675 |
| | 0.7 | 0.01 | 0.08 | 0.08 | 3720 |
| | 0.8 | 0.01 | 0.08 | 0.08 | 3540 |
| | 1.0 | 0.01 | 0.08 | 0.08 | 3310 |
| solvent extracted basestock | 0.2 | 0.01 | 0.08 | 0.08 | 1452 |
| | 0.4 | 0.01 | 0.08 | 0.08 | 1860 |
| | 0.6 | 0.01 | 0.08 | 0.08 | 2565 |
| | 0.8 | 0.01 | 0.08 | 0.08 | 2515 |

TABLE 2-continued

| Base Stock | Phenyl naphthyl amine | Thiadiazole | Benzo-triazole | Succini-mide (50% active) | RBOT (minutes) |
|---|---|---|---|---|---|
| blend | 1.0 | 0.01 | 0.08 | 0.08 | 2265 |
| hydro-isomerized Fischer-Tropsch wax basestock | 0.4 | 0.01 | 0.08 | 0.08 | 4065 |

From the above it is seen that the improvement in oxidation performance resulting from the use of the recited combination of non-alkylated phenyl naphthyl amine, benzotriazole and thiadiazole is uniformly achieved in the different base stocks from different sources which were processed in different ways. There also appears to be a consistent preferred concentration for the non-alkylated phenyl naphthyl amine, the range of about 0.6–0.8 wt % phenyl naphthyl amine producing the maximum observed RBOT lifetimes.

Example 3

The following formulations in Table 3 demonstrate that formulations containing alkylated phenyl naphthyl amine, in combination with thiadiazole and benzotriazole, exhibit oxidation lives significantly shorter than those observed for formulations using the same base oils but containing non-alkylated phenyl naphthyl amine (compare Table 2) in place of alkylated phenyl naphthyl amine.

Unexpectedly, the use of the non-alkylated phenyl naphthyl amine achieves long oxidation lives as compared to alkylated phenyl naphthyl amine.

TABLE 3

| Base Stock | Alkylated Phenyl naphthyl amine | Thiadi-azole | Benzo-triazole | Succini-mide (50% active) | RBOT (minutes) |
|---|---|---|---|---|---|
| Severely Hydrotreated Base Stock Blend (Same as in Table 2) | 0.2 | 0.01 | 0.08 | 0.08 | 1395 |
| | 0.4 | 0.01 | 0.08 | 0.08 | 1420 |
| | 0.6 | 0.01 | 0.08 | 0.08 | 1760 |
| | 0.8 | 0.01 | 0.08 | 0.08 | 1940 |
| | 1.0 | 0.01 | 0.08 | 0.08 | 1992 |
| | 1.2 | 0.01 | 0.08 | 0.08 | 1990 |
| Hydrocracked Base Stock Blend (Same as in Table 2) | 0.2 | 0.01 | 0.08 | 0.08 | 1730 |
| | 0.4 | 0.01 | 0.08 | 0.08 | 2265 |
| | 0.6 | 0.01 | 0.08 | 0.08 | 2420 |
| | 0.8 | 0.01 | 0.08 | 0.08 | 1910 |

What is claimed is:

1. A lubricating oil of enhanced oxidation resistance comprising a major amount of a naturally or synthetically derived base oil, or a mixture of such base oils, of lubricating viscosity, and a minor amount of additives comprising unsubstituted phenyl naphthyl amine present in an amount in the range of about 0.05 to 1 wt % active ingredient, one or more dimercaptothiadiazoles or derivatives thereof of the formula

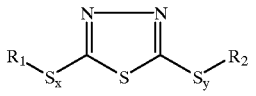

present in an amount in the range of about 0.001 to 0.5 wt % active ingredient, wherein $R_1$ and $R_2$ are the same or different, and are selected from hydrogen, $C_1$–$C_{20}$ hydrocarbyl or $C_1$–$C_{20}$ alkyl and wherein at least one of $R_1$ or $R_2$ is not hydrogen, and x and y are the same or different integers ranging from 1 to 5, and one or more triazoles or benzotriazoles or derivatives thereof of the formula

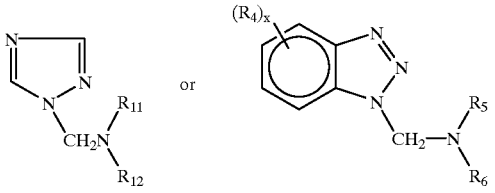

present in an amount in the range of about 0.005 to 0.5 wt % active ingredient, wherein $R_4$ is hydrogen or $C_1$–$C_{10}$ alkyl and x is an integer ranging from 1 to 4, $R_5$ and $R_6$ are hydrocarbyl or substantially hydrocarbyl, $R_{11}$ and $R_{12}$ are hydrocarbyl or substantially hydrocarbyl, in the absence of diphenylamine or diamine antioxidants.

2. The lubricating oil of claim 1 wherein the amount of unsubstituted phenyl naphthyl amine is in the range of about 0.3 to 0.8 wt % active ingredient the dimercaptothiadiazole or derivative thereof is in the range of about 0.01 to 0.10 wt % active ingredient, and the triazole or benzotriazole or derivative thereof is in the range of about 0.01 to 0.20 wt % active ingredient.

3. A method for enhancing the oxidation resistance of a lubricating oil comprising adding to the lubricating oil a minor amount of additives comprising unsubstituted phenyl naphthyl amine in an amount in the range of about 0.05 to 1 wt % active ingredient, one or more dimercaptothiadiazoles or derivatives thereof of the formula

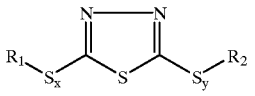

present in an amount in the range of about 0.001 to 0.5 wt % active ingredient, wherein $R_1$ and $R_2$ are the same or different, and are selected from hydrogen, $C_1$–$C_{20}$ hydrocarbyl or $C_1$–$C_{20}$ alkyl and wherein at least one of $R_1$ or $R_2$ is not hydrogen, and x and y are the same or different integers ranging from 1 to 5, and one or more triazoles or benzotriazoles or derivatives thereof of the formula

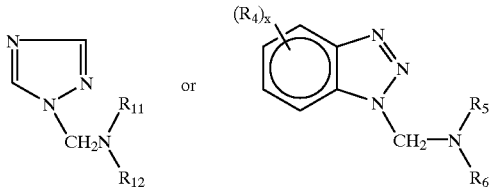

present in an amount in the range of about 0.005 to 0.5 wt % active ingredient, wherein $R_4$ is hydrogen or $C_1$–$C_{10}$ alkyl and x is an integer ranging from 1 to 4, $R_5$ and $R_6$ are hydrocarbyl or substantially hydrocarbyl, $R_{11}$ and $R_{12}$ are hydrocarbyl or substantially hydrocarbyl, in the absence of diphenylamine or diamine antioxidants.

4. The method of claim 3 wherein the amount of unsubstituted phenyl naphthyl amine is in the range of about 0.3 to 0.8 wt % active ingredient, the dimercaptothiadiazole or derivative thereof is in the range of about 0.01 to 0.10 wt % active ingredient, and the triazole or benzotriazole or derivative thereof is in the range of about 0.01 to 0.20 wt % active ingredient.

* * * * *